US010464326B2

(12) United States Patent
Fujimori et al.

(10) Patent No.: US 10,464,326 B2
(45) Date of Patent: Nov. 5, 2019

(54) LIQUID EJECTING APPARATUS

(71) Applicant: SEIKO EPSON CORPORATION, Tokyo (JP)

(72) Inventors: Ryoji Fujimori, Suwa (JP); Takeshi Iwata, Azumino (JP); Chikashi Nakamura, Azumino (JP); Shuhei Harada, Chino (JP); Kazutoshi Shimizu, Shimosuwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/039,688

(22) Filed: Jul. 19, 2018

(65) Prior Publication Data

US 2019/0023017 A1 Jan. 24, 2019

(30) Foreign Application Priority Data

Jul. 20, 2017 (JP) ..... 2017-140765

(51) Int. Cl.
*B41J 2/165* (2006.01)

(52) U.S. Cl.
CPC ..... *B41J 2/16532* (2013.01); *B41J 2/16508* (2013.01); *B41J 2/16517* (2013.01); *B41J 2/16523* (2013.01); *B41J 2/16526* (2013.01); *B41J 2/16535* (2013.01); *B41J 2/16544* (2013.01); *B41J 2002/1655* (2013.01); *B41J 2002/1657* (2013.01)

(58) Field of Classification Search
CPC ..... B41J 2/16532; B41J 2/16508; B41J 2/16517; B41J 2/16523; B41J 2/16526; B41J 2/16535; B41J 2/16544; B41J 2002/1655; B41J 2002/1657
See application file for complete search history.

(56) References Cited

U.S. PATENT DOCUMENTS 6,520,621 B1 10/2003 Hampson
2012/0299996 A1* 11/2012 Kano ..... B41J 2/16532 347/33
2014/0218440 A1 8/2014 Komatsu et al.
(Continued)

FOREIGN PATENT DOCUMENTS

JP 2001-121712 A 5/2001
JP 2005-138479 A 6/2005
(Continued)

*Primary Examiner* — Thinh H Nguyen
(74) *Attorney, Agent, or Firm* — Workman Nydegger

(57) ABSTRACT

A liquid ejecting apparatus includes a liquid ejecting head having nozzles for ejecting a liquid, and an attachment section to which a maintenance unit to be used for maintenance of the liquid ejecting head is to be detachably attached. If the maintenance unit having a maintenance mechanism for performing the maintenance by driving force transmitted from the attachment section is a first unit and the maintenance unit having no maintenance mechanism is a second unit, one of a plurality of the maintenance units including the first unit and the second unit and having different structure is interchangeably attached to the attachment section, and the attachment section includes an identification section configured to identify the structure of the attached maintenance unit and a driving-force transmission section configured to transmit the driving force to the attached first unit.

9 Claims, 10 Drawing Sheets

(56) References Cited

U.S. PATENT DOCUMENTS

| | | | |
|---|---|---|---|
| 2016/0121614 | A1 | 5/2016 | Shinoto et al. |
| 2016/0144626 | A1 | 5/2016 | Nakagawa et al. |

FOREIGN PATENT DOCUMENTS

| | | | |
|---|---|---|---|
| JP | 2006-198941 | A | 8/2006 |
| JP | 2008-000643 | A | 1/2008 |
| JP | 2014-148128 | A | 8/2014 |
| JP | 2016-087939 | | 5/2016 |
| JP | 2016-097597 | A | 5/2016 |

* cited by examiner

LIQUID EJECTING APPARATUS

BACKGROUND

1. Technical Field

The present invention relates to a liquid ejecting apparatus such as a printer.

2. Related Art

Example liquid ejecting apparatuses include an ink jet recording apparatus that includes a cap unit that can be changed depending on an ink to be used and a sensor for detecting whether the cap unit corresponding to the ink has been attached, for example, as disclosed in JP-A-2006-198941.

Depending on the type of ink, in some cases, in addition to the change of a cap unit, a suction pump for sucking inside the cap is also to be changed together with the cap unit.

SUMMARY

An advantage of some aspect of the invention is that there is provided a liquid ejecting apparatus to which one of maintenance units having different structures can be attached and maintenance corresponding to the attached structure can be readily performed.

A liquid ejecting apparatus for solving the above-mentioned problems include a liquid ejecting head having nozzles for ejecting a liquid, and an attachment section to which a maintenance unit to be used for maintenance of the liquid ejecting head is to be detachably attached. If the maintenance unit having a maintenance mechanism for performing the maintenance by driving force transmitted from the attachment section is a first unit and the maintenance unit having no maintenance mechanism is a second unit, one of a plurality of the maintenance units including the first unit and the second unit and having different structure is interchangeably attached to the attachment section, and the attachment section includes an identification section configured to identify the structure of the attached maintenance unit and a driving-force transmission section configured to transmit the driving force to the attached first unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid ejecting apparatus according to an embodiment will be described with reference to the attached drawings. The liquid ejecting apparatus is, for example, an ink jet printer that performs printing at a print position by ejecting an ink, which is an example liquid, onto a medium such as paper.

Figure 1:
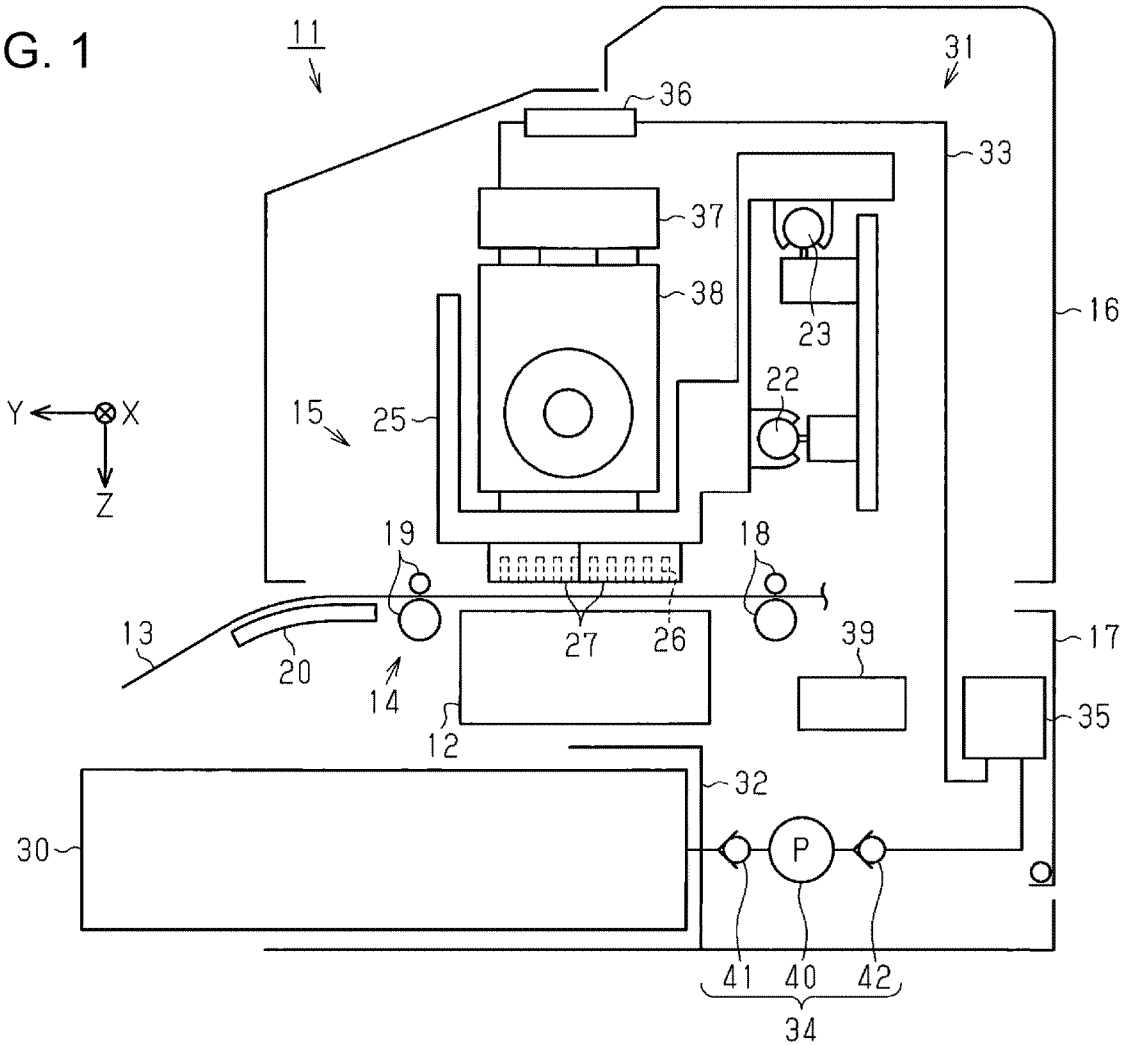
FIG. 1 is an overall structure of a liquid ejecting apparatus according to an embodiment.

As illustrated in FIG. 1, a liquid ejecting apparatus 11 includes a support base 12 for supporting a medium 13 at a print position, a transport mechanism 14 that transports the medium 13, a print unit 15, guiding shafts 22 and 23, and a casing 16 that accommodates these components. The support base 12 and the guiding shafts 22 and 23 extend in an X-axis direction, which is a width direction of the medium 13. To the casing 16, an openable and closable cover 17 is attached.

The print unit 15 ejects a liquid at a print position and thereby printing is performed onto the medium 13. A transport direction of the medium 13 at the print position is referred to as a Y-axis direction. The X axis and the Y axis intersect a Z axis. In this embodiment, the Z-axis direction is the direction of gravity and the direction of liquid ejection.

The transport mechanism 14 includes transport roller pairs 18 and 19 that are disposed on an upstream side and a downstream side of the support base 12 in the transport direction respectively, a guide plate 20 that is disposed on the downstream side of the transport roller pair 19 in the transport direction, and a transporting motor (not illustrated) that rotates the transport roller pairs 18 and 19. The transport roller pairs 18 and 19 that rotate while nipping the medium 13 transport the medium 13 along the surface of the support base 12 and the surface of the guide plate 20.

Figure 2:
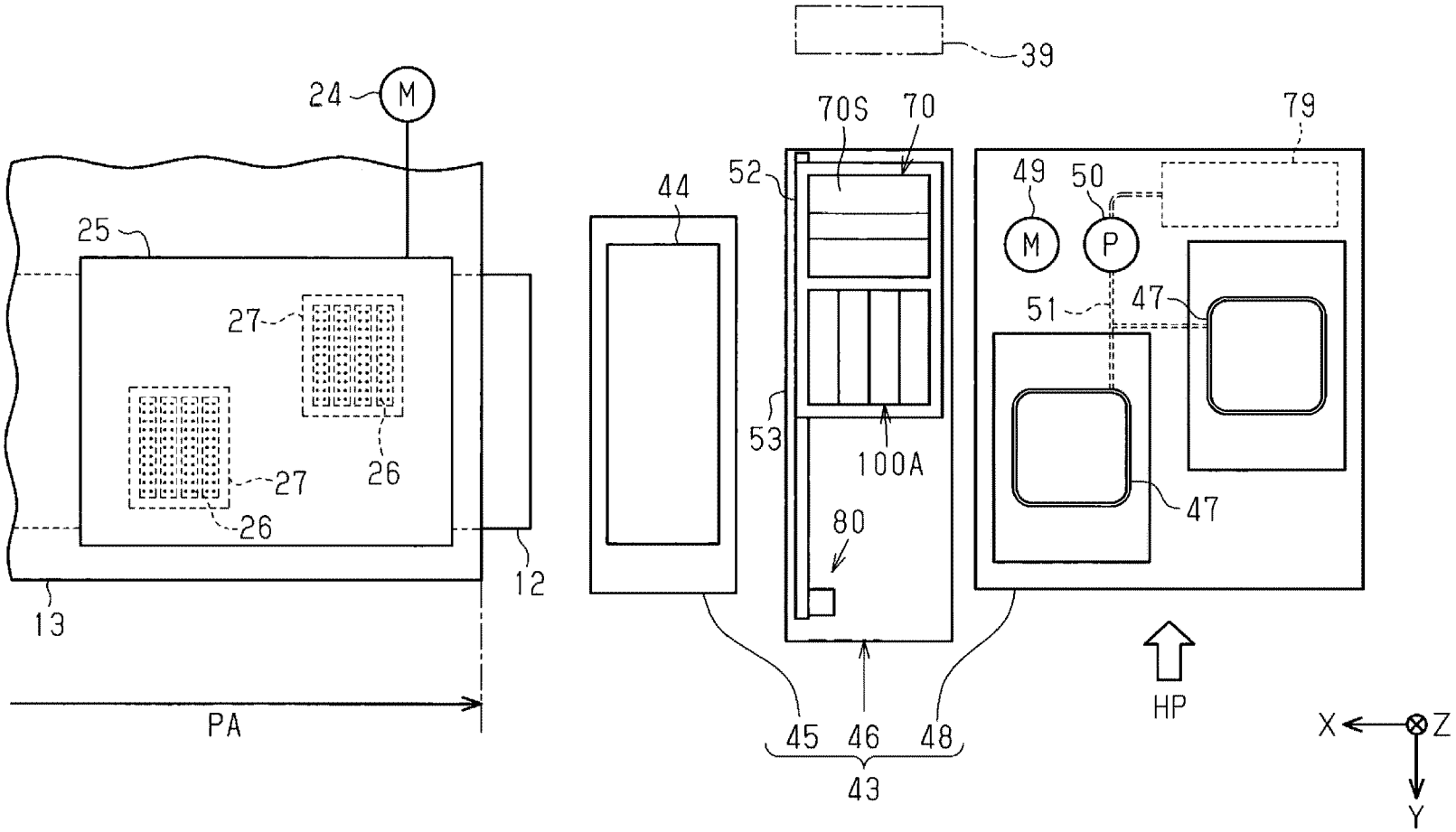
FIG. 2 is a plan view of a support base and a maintenance mechanism provided in the liquid ejecting apparatus in FIG. 1.

The print unit 15 includes a carriage 25 that is supported by the guiding shafts 22 and 23 and a carriage motor 24 (see FIG. 2). The carriage motor 24 provides a driving force to reciprocate the carriage 25 along the guiding shafts 22 and 23 above the support base 12.

To a lower end section of the carriage 25, at least one, in this embodiment, two liquid ejecting heads 27 are attached. The two liquid ejecting heads 27 are disposed at a predetermined distance in the X-axis direction and shifted at a predetermined distance in the Y-axis direction. Each liquid ejecting head 27 has nozzles 26 for ejecting a liquid.

To the carriage 25, a part of a supply mechanism 31 for supplying an ink from a liquid container 30 to the liquid ejecting head 27 is attached. The liquid container 30 is detachably attached to a holder 32. The supply mechanism 31 causes an ink to flow from the liquid container 30 toward the liquid ejecting head 27. At least one pair of the liquid container 30 and the supply mechanism 31 is provided for each ink, and in this embodiment, four liquid containers 30 and four supply mechanisms 31 (four pairs) are provided.

Example liquids include color inks such as a cyan (C) ink, a magenta (M) ink, and a yellow (Y) ink, a black (K) ink, and a white ink. Alternatively, other than the four colors of inks of CMYK, the inks to be used for printing may include inks of light magenta, light cyan, light yellow, gray, orange, and white, or may be three inks of CMY, or may be only the black ink. Color printing may be performed by using a plurality of colors of inks. The white ink may also be used for background printing.

Example inks include pigment inks that are aqueous inks. The pigment ink contains a large number of pigment particles dispersing in the liquid used as a dispersion medium. The cyan, magenta, and yellow pigments employ organic pigments having average particle diameters of about 100 nm, and the black pigment employs, for example, carbon black (inorganic pigment) having an average diameter of about 120 nm.

The liquid ejecting head 27 can eject, in addition to ink, treatment liquid (curing agent) for accelerating curing of ink. The treatment liquid for curing may be ejected onto the medium 13 prior to the ink or may be ejected after the ink.

The supply mechanism 31 includes a supply path 33 for supplying an ink from the liquid container 30 to the liquid ejecting head 27. The supply path 33 includes, from the upstream side, a supply pump 34 for causing an ink to flow, a filter unit 35 for catching bubbles or foreign matter in an ink, a static mixer 36 for changing the flow of an ink in the supply path 33 to stir the ink, a liquid reservoir 37 for storing an ink, and a pressure adjustment unit 38 for adjusting the pressure of an ink.

The supply pump 34 includes a diaphragm pump 40 that can vary the capacity of a pump room, a suction valve 41 that is disposed on the upstream side of the diaphragm pump 40, and a discharge valve 42 that is disposed on the downstream side of the diaphragm pump 40. The suction valve 41 and the discharge valve 42 are unidirectional valves that allow an ink to flow toward the downstream side and regulate the flow of the ink toward the upstream side.

The supply pump 34 sucks an ink from the liquid container 30 through the suction valve 41 as the capacity of the pump room in the diaphragm pump 40 increases, and discharges the ink through the discharge valve 42 toward the downstream side as the capacity of the pump room decreases. The filter unit 35 is disposed at a position to be exposed when the cover 17 is opened and is detachably attached to the supply path 33. The filter unit 35 can be replaced when the cover 17 is open.

The liquid ejecting apparatus 11 includes a controller 39 that controls the driving of the transporting motor (not illustrated) for driving the transport roller pairs 18 and 19, the driving of the carriage motor 24 (see FIG. 2) and the supply pump 34, and controls the ejecting of the liquid ejecting head 27.

Maintenance Mechanism

As illustrated in FIG. 2, the liquid ejecting apparatus 11 includes a maintenance device 43 for maintaining the liquid ejecting head 27. If the area where the medium 13 is to be transported on the support base 12 is defined as a transport area PA, the maintenance device 43 is disposed outside the transport area PA.

The maintenance device 43 includes a flushing unit 45, a movable unit 46, and a cap unit 48, which are disposed in order from a position closer to the transport area PA in the X-axis direction. The area at which the cap unit 48 is disposed is referred to as a home position HP. The liquid ejecting head 27 stands by at the home position HP when no printing operation is performed.

Flushing refers to a maintenance operation performed by the liquid ejecting head 27 in order to eject a liquid to prevent or solve clogging of the nozzles 26, and the operation is conducted when no printing operation is performed. The flushing unit 45 includes a liquid receiving section 44 that can receive a liquid ejected by the liquid ejecting head 27.

The cap unit 48 includes two caps 47, a suction pump 50, and a suction tube 51 that connects the two caps 47 and the suction pump 50. A downstream side end of the suction tube 51 is connected to a waste liquid tank 79. The two caps 47 are positioned below the two liquid ejecting heads 27 when the carriage 25 stops at the home position HP. The caps 47 are driven by a capping motor 49 to move between positions where the caps 47 can come into contact with the liquid ejecting heads 27 and positions where the caps 47 are away from the liquid ejecting heads 27. The controller 39 controls the driving of the capping motor 49.

The caps 47 come into contact with the liquid ejecting heads 27 so as to surround the nozzles 26 to form a space where the nozzles 26 open. This operation of the caps 47 to come into contact with the liquid ejecting heads 27 is referred to as capping. The capping can help prevent drying of the nozzles 26. The caps 47 perform the capping, for example, when the liquid ejecting heads 27 are not printing.

When the suction pump 50 is driven while the capping is performed, the inside of the liquid ejecting head 27 is sucked through the suction tube 51 and the cap 47. This maintenance operation of sucking is referred to as suction cleaning. By the suction cleaning, foreign matter such as a thickened liquid and/or bubbles can be discharged together with the liquid, and the discharged liquid is stored in the waste liquid tank 79. The controller 39 controls the driving of the capping motor 49 and the suction pump 50.

The movable unit 46 includes a cassette holder 52 that can be reciprocated in the Y-axis direction, a guide frame 53 that guides the cassette holder 52, and a holder drive section 80 that moves the cassette holder 52. To the cassette holder 52, a wiper cassette 70 and a liquid receiving unit 100A are detachably attached in the Y-axis direction.

The wiper cassette 70 includes a fabric sheet 70S for wiping the liquid ejecting head 27. The fabric sheet 70S is a roll of a strip-shaped material. Preferably, the fabric sheet 70S is an absorbing material that can absorb ink. The fabric sheet 70S is unwound from the roll and wipes the liquid ejecting head 27 while the wiper cassette 70 moves together with the cassette holder 52. The maintenance operation of wiping is referred to as wiping.

The liquid receiving unit 100A receives a liquid ejected from the liquid ejecting head 27. It is preferable that the flushing unit 45 be disposed such that while one of the liquid ejecting head 27 that is closer to the home position HP in FIG. 2 is positioned above the liquid receiving unit 100A, the other liquid ejecting head 27 be positioned above the liquid receiving section 44. Such an arrangement enables the two liquid ejecting heads 27 to perform flushing; the two liquid ejecting heads 27 can similarly eject liquids. The liquids discharged as a result of the flushing may be received by the fabric sheet 70S. In such a case, it is preferable that the liquids be received by used fabric sheet 70S.

Head Unit

Figure 3:
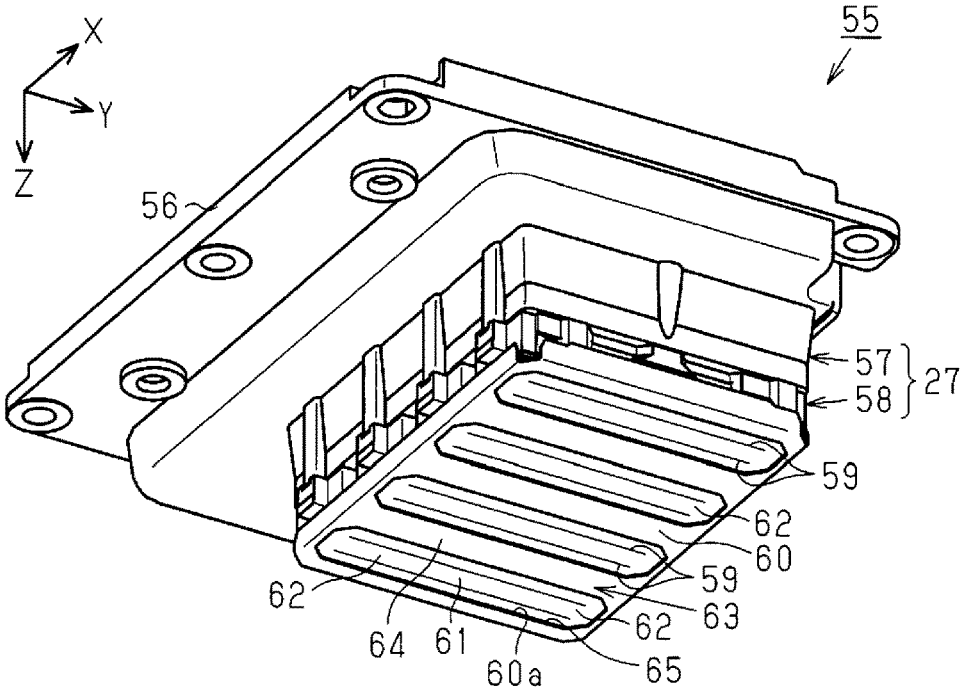
FIG. 3 is a perspective view of a head unit provided in the liquid ejecting apparatus in FIG. 1.

As illustrated in FIG. 3, a head unit 55 includes a bracket 56 for attachment to the carriage 25, and the liquid ejecting head 27 that protrudes downward from the bracket 56. The head unit 55 is attached to the lower surface of the carriage 25. The liquid ejecting head 27 includes a flow path forming section 57 that protrudes downward from the bracket 56 and a head body 58 that is fixed to the lower part of the flow path forming section 57.

A lower surface of the head body 58 is referred to as a nozzle opening surface 61 in which a plurality of nozzle arrays (for example, 8 arrays) 59 are provided. A liquid-repellent treatment for readily repelling liquid has been performed to form a liquid-repellent film 66 on the nozzle opening surface 61. The liquid-repellent film 66 may be a liquid-repellent coating film or a liquid-repellent monolayer, and any appropriate film sickness and any appropriate liquid-repellent treatment method may be selected for the film.

A pigment ink contains a large number of pigment particles dispersing in the liquid used as a dispersion medium. Accordingly, in this embodiment, the liquid-repellent film 66 is a water-repellent film that repels aqueous ink. The liquid-repellent film 66 may include, for example, a thin-film coating mainly composed of polyorganosiloxane containing an alkyl group and a liquid-repellent film layer composed of a metal alkoxide having a long chain polymer group containing fluorine. The liquid-repellent film 66 gradually wares due to wiping and its liquid repellency decreases as the level of ware of the liquid-repellent film 66 exceeds a certain level.

The liquid-repellent film 66 with decreased liquid repellency reduces the wetting angle (contact angle) of the liquid such as ink mist with respect to nozzle peripheries 62. Accordingly, the liquid droplets adhering to the nozzle peripheries 62 spread wet and tend to grow into larger droplets. The grown liquid droplets may be formed in the vicinity of the nozzles 26, blocking the openings of some nozzles 26, or flowing into the nozzles 26.

When the nozzles 26 eject liquid droplets with the liquid droplets adhering to the nozzle peripheries 62, the ejected liquid droplets come into contact with the liquid droplets and may bend the trajectories of the ejected liquid droplets. The bending of the liquid droplet trajectories may change the positions on the medium 13 at which the liquid droplets are intended to land and may decrease the quality of the image. For this reason, the ware in the liquid-repellent films 66 due to wiping needs to be suppressed as much as possible.

To the head body 58, a plate-like cover member 60 having a plurality of (for example, four) through-holes 60*a* is attached so as to cover a part of the nozzle opening surface 61. The cover member 60 is made of, for example, a metal such as a stainless steel.

Figure 4:
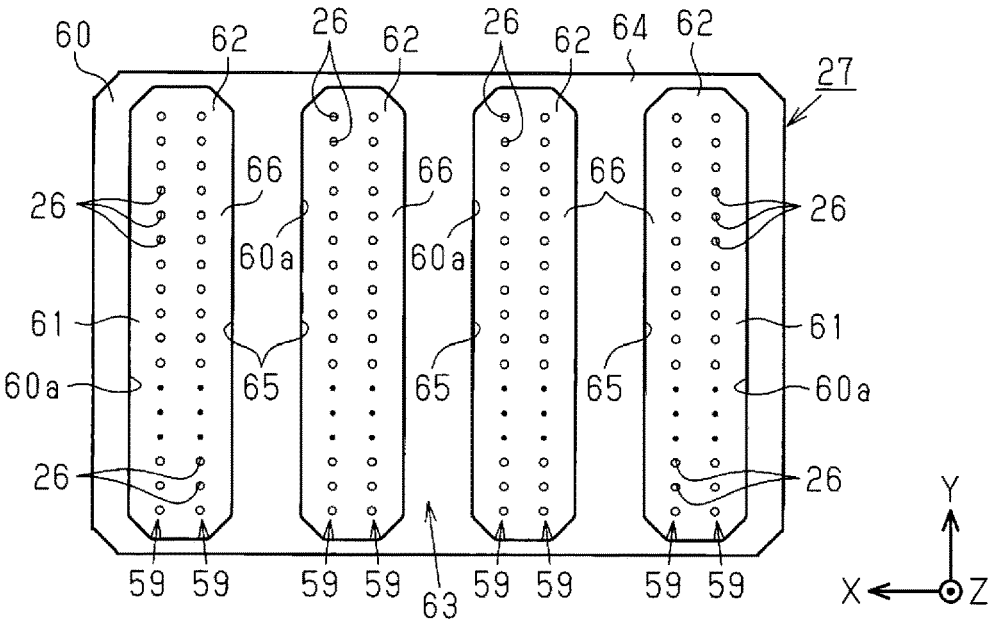
FIG. 4 is a schematic plan view of a nozzle surface of the head unit in FIG. 3.

As illustrated in FIG. 4, each of the through-holes 60*a* exposes a predetermined number (for example, two arrays) of nozzle arrays 59. The through-hole 60*a* may be provided for each nozzle array 59. The region exposed by the through-hole 60*a* in the nozzle opening surface 61 is referred to as the nozzle periphery 62. The nozzles 26 are open in the nozzle peripheries 62.

The nozzle array 59 includes a large number (for example, 180 or 360) of nozzles 26 aligned in the Y-axis direction at a constant pitch. The nozzle arrays 59 may include unused nozzle arrays that do not eject liquid.

A group (in this embodiment, the nozzles 26 constituting the two rows of nozzle arrays 59) of the nozzles 26 that are exposed through one through-hole 60*a* is referred to as a nozzle group. One nozzle group includes a plurality of nozzles 26 for ejecting the same type of liquid.

The liquid ejecting head 27 according to the embodiment has four nozzle groups. In FIG. 2, three nozzle groups closer to the home position HP (see FIG. 2) eject inks of different colors respectively, whereas the one nozzle group farthest from the home position HP ejects a treatment liquid for accelerating hardening of ink.

Figure 5:
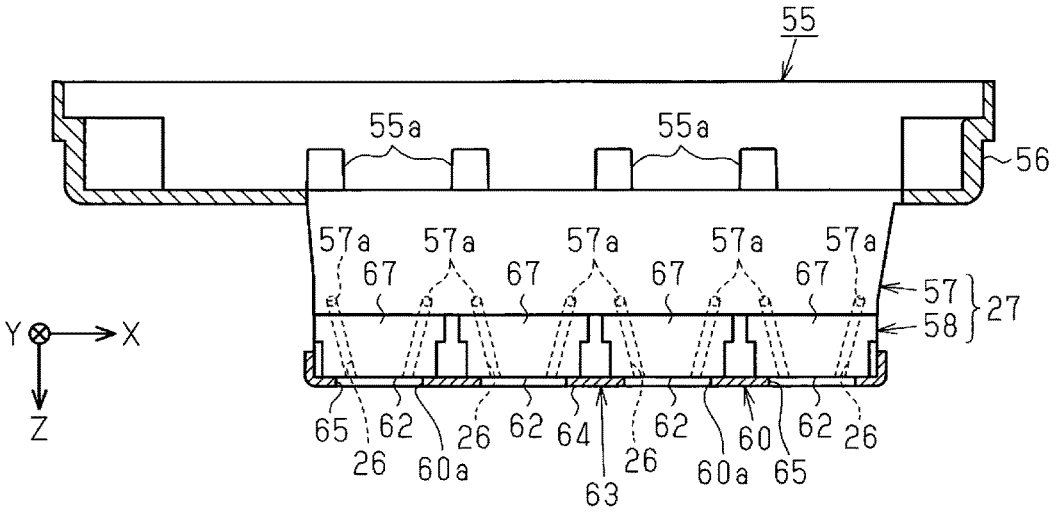
FIG. 5 is a cross-sectional view of the head unit in FIG. 3.

As illustrated in FIG. 5, a lower surface of the cover member 60 is referred to as a protruding surface 64. On the surface of the cover member 60, no liquid-repellent treatment is performed. Accordingly, the liquid repellency of the protruding surface 64 is lower than that of the nozzle peripheries 62.

The protruding surface 64 protrudes downward more than the nozzle peripheries 62 by the thickness (in this embodiment, 0.1 mm) of the cover member 60. Consequently, a step 65 of about 0.1 mm exists between the nozzle peripheries 62 and the protruding surface 64. The surface (lower surface) of the liquid ejecting head 27 that includes the nozzle peripheries 62 and the protruding surface 64 is referred to as a nozzle surface 63. The nozzle surface 63 is a target of wiping.

As illustrated in FIG. 5, the liquid ejecting head 27 has a plurality of (in this embodiment, four) recording heads 67 (unit heads) that are arranged in parallel at a constant pitch in the X-axis direction. The peripheral edge portion of the nozzle opening surface 61, which is the lower surface of the recording head 67, is covered by the cover member 60, and the nozzle peripheries 62 including the two arrays of nozzles 26 are exposed through the through-holes 60*a*, which are provided in the cover member 60.

Figure 6:
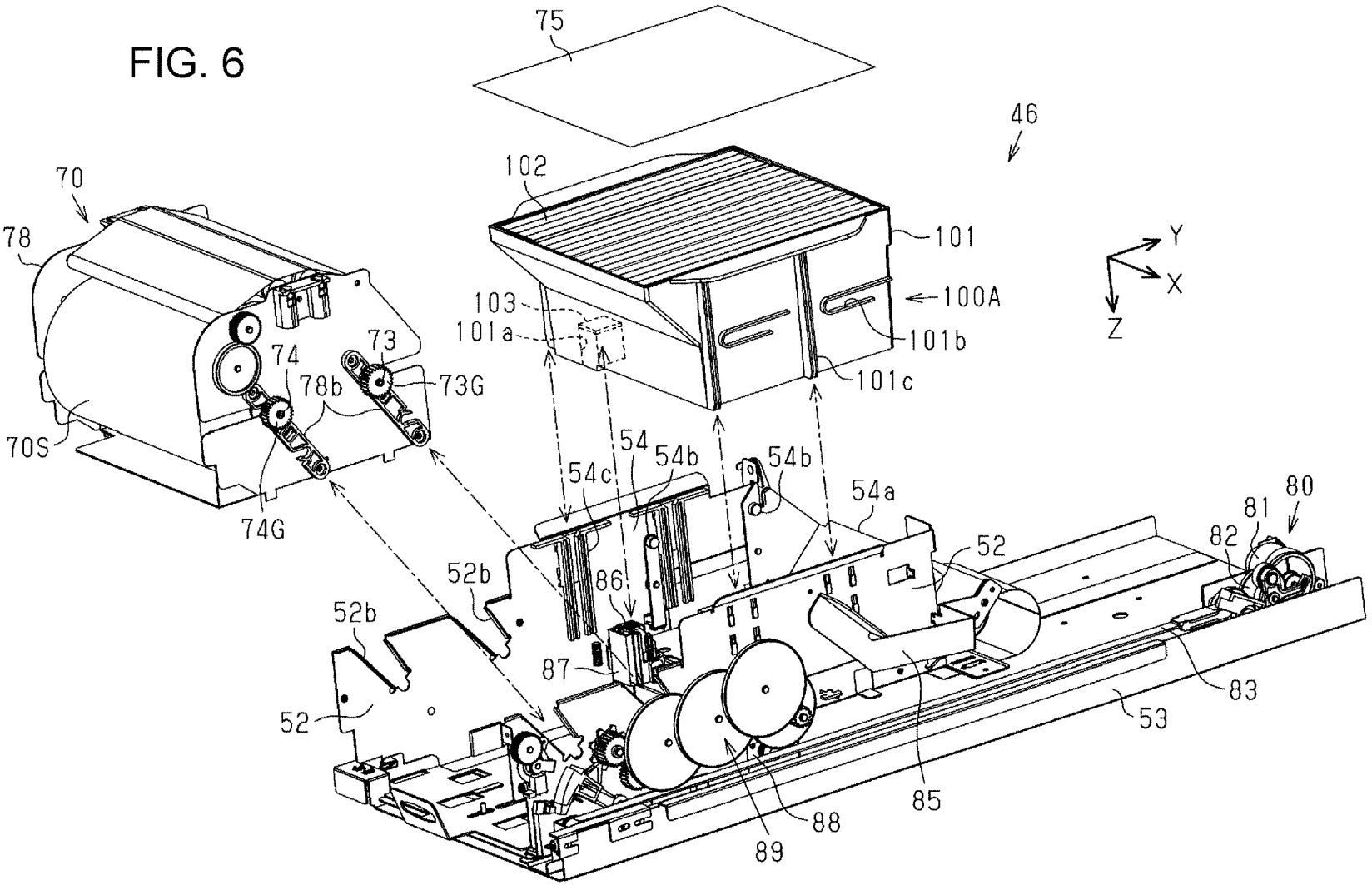
FIG. 6 is an exploded perspective view of a movable unit in the maintenance mechanism in FIG. 2.

The nozzles 26 communicate with ink flow paths 57*a* that pass through the inside of the flow path forming section 57, and the ink flow paths 57*a* communicate with a plurality of supply tube sections 55*a*, which protrude upward from the upper surface of the flow path forming section 57, via flow paths (not illustrated). The supply tube sections 55*a* communicate with supply ports of the pressure adjustment unit 38 (see FIG. 1), which are mounted on the carriage 25, via flow paths (not illustrated). Liquids are supplied from the pressure adjustment unit 38 (see FIG. 1) via the supply tube sections 55*a* and the ink flow paths 57*a* to the nozzles 26 of corresponding recording heads 67 respectively. Movable Unit As illustrated in FIG. 6, the wiper cassette 70 and the liquid receiving unit 100A are detachably mounted to the cassette holder 52 of the movable unit 46. The cassette holder 52 has slits 52*b* for attaching the wiper cassette 70, and an attachment section 54 for attaching the liquid receiving unit 100A.

The wiper cassette 70 has cassette frames 78 that have convex portions 78*b* engageable with the slits 52*b*. The wiper cassette 70 is attached to the cassette holder 52 by inserting the convex portions 78*b* into the slits 52*b*, and detached from the cassette holder 52 by pulling upward the wiper cassette 70 from the slits 52*b*.

The liquid receiving unit 100A includes an absorber 102 that can absorb liquid, a container 101 that holds the absorber 102, and a memory 103 that stores information concerning the structure of the liquid receiving unit 100A.

The liquid receiving unit 100A may include a film 75 that is disposed so as to cover the absorber 102. If the surface of the absorber 102 becomes fluffy, the fluff may adhere to the liquid ejecting head 27. The absorber 102 covered with the film 75 can suppress the fluffing and fluff scattering. The film 75 may be composed of a material that is soluble in the liquid ejected by the liquid ejecting head 27. For example, if the liquid to be received is a water-soluble ink, the film 75 may be a water-soluble film. In such a case, the film 75 dissolves when the liquid receiving unit 100A receives the liquid, and thus the liquid absorption by the absorber 102 is not prevented.

The liquid receiving unit 100A is attached to the cassette holder 52 by inserting the liquid receiving unit 100A into the attachment section 54 in the Z-axis direction, and detached from the attachment section 54 by pulling upward the liquid receiving unit 100A. The cassette holder 52 may include a lever 85 that is to be pressed and turned downward by the attached liquid receiving unit 100A. In such a case, by turning upward the lever 85 while the liquid receiving unit 100A is being attached to the attachment section 54, the liquid receiving unit 100A can be pulled out from the cassette holder 52.

The attachment section 54 may include a wall section 54*a* and engagement convex sections 54*b* that turn in conjunction with the lever 85, and guide ribs 54*c* that extend in the insertion direction of the liquid receiving unit 100A. In such a case, the container 101 may include engagement concave sections 101*b* and engagement ribs 101*c* that engage with the engagement convex sections 54*b* and the guide ribs 54*c* respectively in attaching the container 101 to the attachment section 54. If the insertion direction of the liquid receiving unit 100A is the Z-axis direction, the engagement concave sections 101*b* may be extended in the Y-axis direction. In such a case, the guide ribs 54*c* that turn in conjunction with the lever 85 move along the engagement concave sections 101*b*, and thereby the attachment of the liquid receiving unit 100A to the attachment section 54 can be supported.

A connection terminal 86 may be disposed on a bottom section of the attachment section 54. The connection terminal 86 is connected to the memory 103 when the liquid receiving unit 100A is attached to the attachment section 54. The connection terminal 86 may be fixed to the top of a supporting member 87 that protrudes upward. In such a case, a concave section 101*a* may be provided on a bottom section of the container 101 and the memory 103 may be disposed in the concave section 101*a*. With this structure, when the liquid receiving unit 100A is attached to the attachment section 54, the supporting member 87 is positioned in the concave section 101*a*, and the connection terminal 86 is connected to the memory 103.

The connection terminal 86 is electrically connected to the controller 39 (see FIG. 2). After the connection terminal 86 is connected to the memory 103, information can be transmitted or received between the memory 103 and the controller 39. With the structure in which the connection terminal 86 fixed to the top of the supporting member 87 and the supporting member 87 is to be inserted into the concave section 101*a*, the adhesion of waste ink or the like to the connection terminal 86 and the memory 103 can be prevented. Consequently, poor connection between the connection terminal 86 and the memory 103 due to the adhesion can be prevented.

A holder drive section 80 is attached to an end portion of the guide frame 53 in the Y-axis direction. The holder drive section 80 includes an electric motor 81 and a power transmission mechanism 82. The power transmission mechanism 82 includes a belt 83 that transmits the power of the electric motor 81 to the cassette holder 52. In response to the drive of the electric motor 81, the cassette holder 52 reciprocates along the Y-axis direction while being guided by a guide frame 53.

Figure 7:
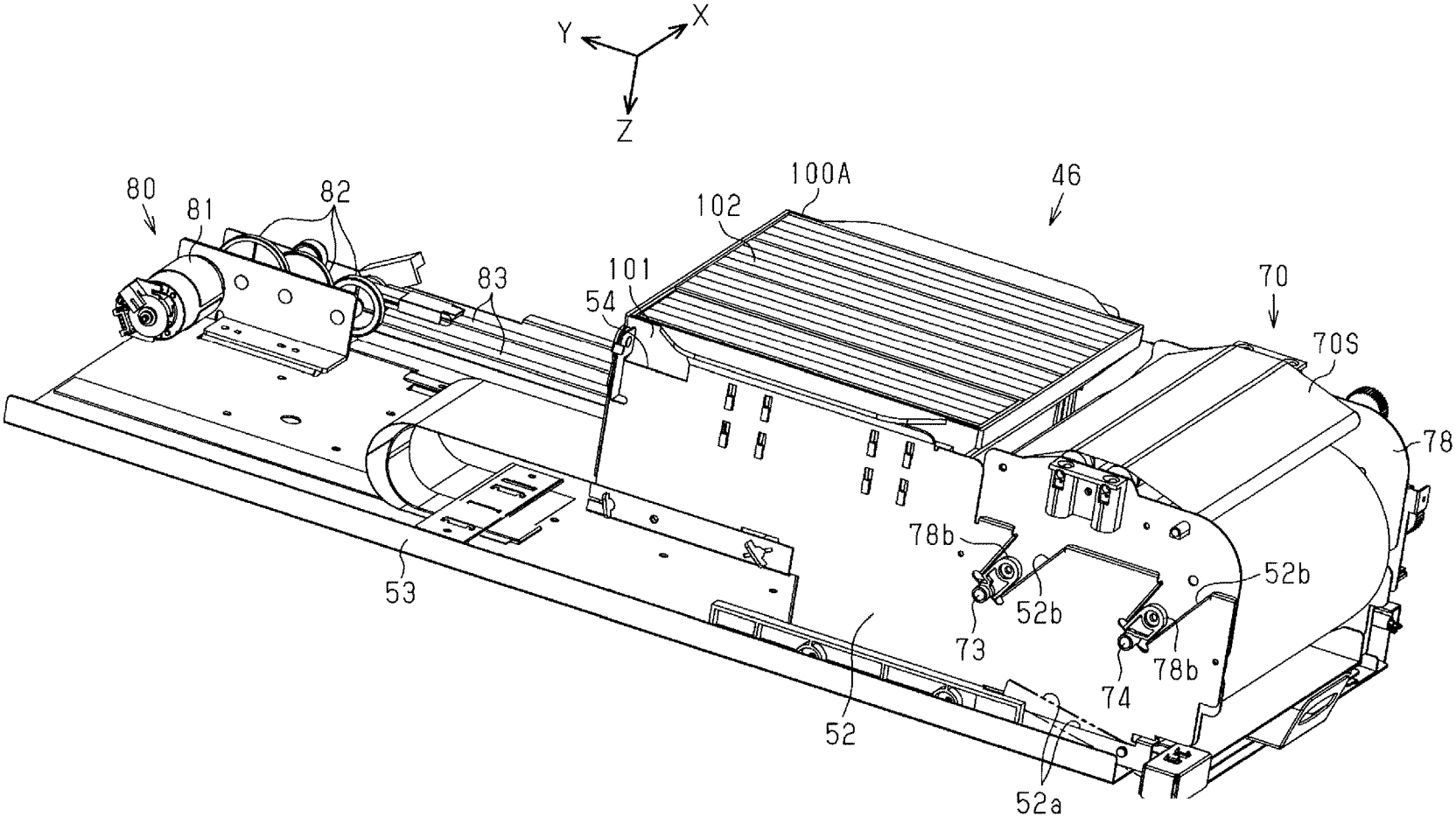
FIG. 7 is a perspective view illustrating the movable unit in FIG. 6.
Figure 8:
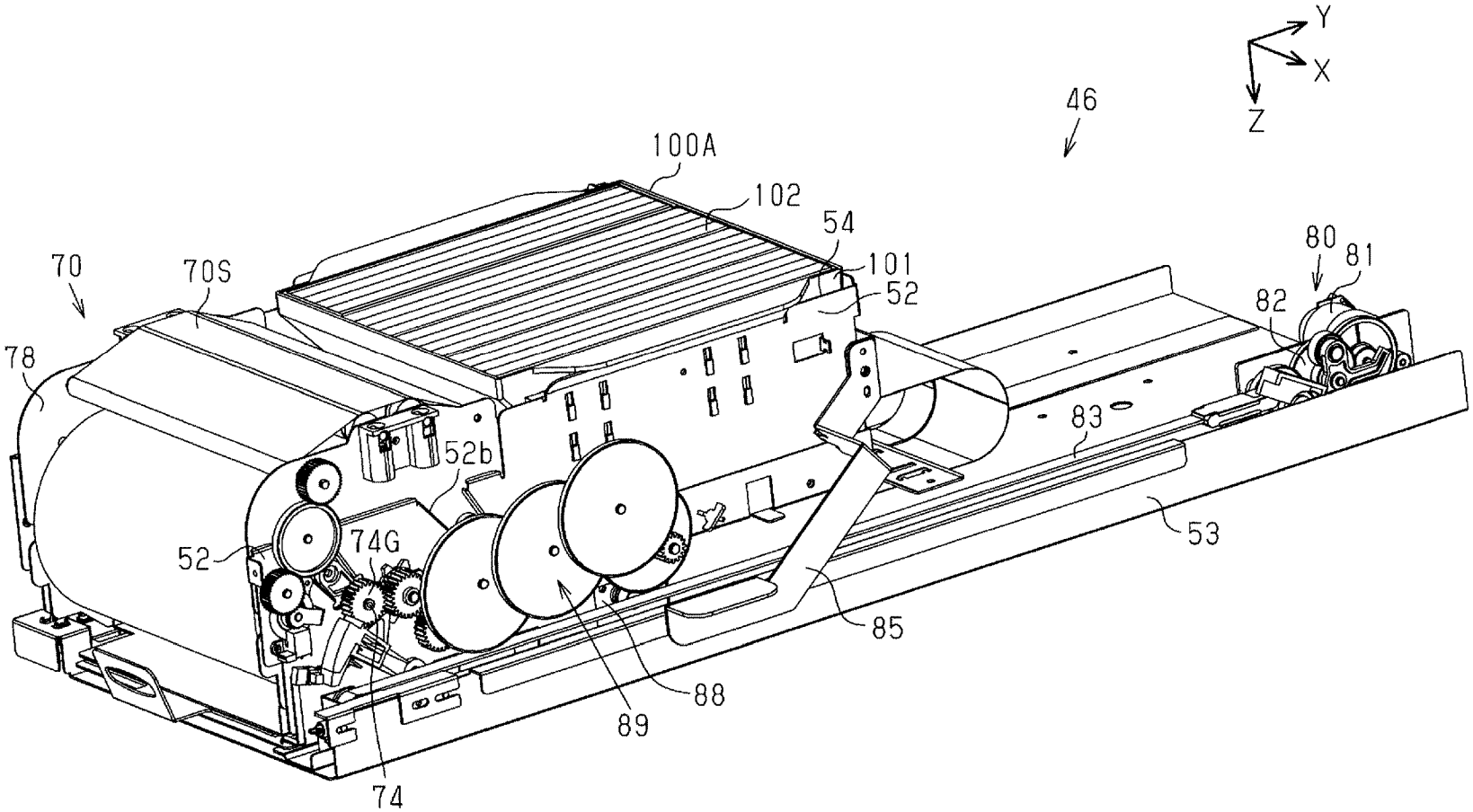
FIG. 8 is a perspective view of the movable unit viewed from the side opposite to the side in FIG. 7.

The cassette holder 52 stands by at an initial position illustrated in FIG. 7 and FIG. 8. In response to the forward rotation of the electric motor 81, the cassette holder 52 moves forward from the initial position toward the holder drive section 80. In response to the reverse rotation of the electric motor 81, the cassette holder 52 moves backward in the direction away from the holder drive section 80, and returns to the initial position.

As illustrated in FIG. 7, the cassette holder 52 includes a swing lever 52*a* that swings in response to the returning of the cassette holder 52 to the initial position by the backward movement. As illustrated in FIG. 7 by the chain double-dashed line and the solid line, the change in the position of the swing lever 52*a* may indicate that the cassette holder 52 has returned to the initial position.

As illustrated in FIG. 8, an electric motor 88 and a gear train 89 that transmits the driving force of the electric motor 88 are attached to the cassette holder 52. The gear train 89 includes a plurality of spur gears. In response to the rotation and drive of the electric motor 88, the gear train 89 transmits the rotation to the wiper cassette 70 that is attached to the cassette holder 52.

As illustrated in FIG. 6, the wiper cassette 70 includes a feeding shaft 74 that feeds a rolled fabric sheet 70S, a gear 74G that is fixed to the feeding shaft 74, a winding shaft 73 that winds the used fabric sheet 70S, and a gear 73G that is fixed to the winding shaft 73. The electric motor 88 rotates the gears 73G and 74G, and the rotation of the gears 73G and 74G winds the fabric sheet 70S onto the winding shaft 73.

Figure 9:
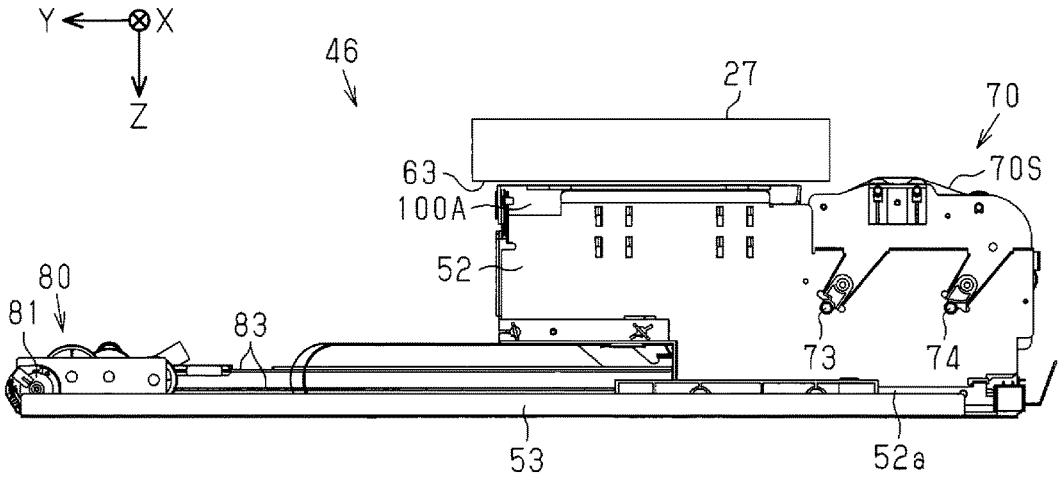
FIG. 9 is a side view illustrating a state of use of a liquid receiving unit attached to the movable unit in FIG. 6.

As illustrated in FIG. 9, the liquid receiving unit 100A is placed below a scanning region of the liquid ejecting head 27 while the cassette holder 52 stands by at the initial position. Consequently, the liquid ejecting head 27 can perform flushing to the liquid receiving unit 100A during the printing or before or after the printing.

Figure 10:
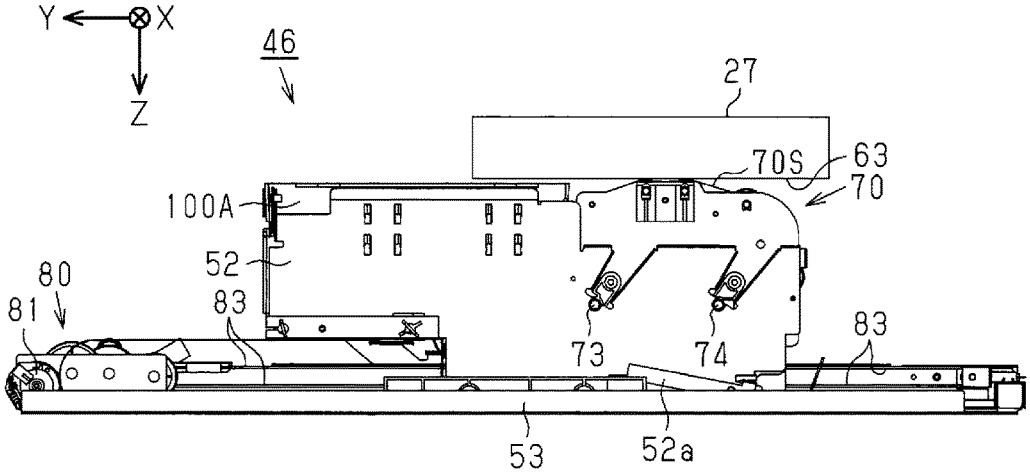
FIG. 10 is a side view illustrating a state of use of a wiper cassette attached to the movable unit in FIG. 6.

To perform wiping, the liquid ejecting head 27 stops above the liquid receiving unit 100A. Then, the cassette holder 52 moves forward from the initial position in the Y-axis direction. As illustrated in FIG. 10, while the cassette holder 52 is moving forward, the nozzle surface 63 of the liquid ejecting head 27 is wiped by the fabric sheet 70S. In response to the completion of the wiping operation to the nozzle surface 63, the electric motor 88 (see FIG. 6) rotates, and the used fabric sheet 70S is wound.

It is preferable that, while the fabric sheet 70S is being wound, the liquid ejecting head 27 move in the X-axis direction so as to leave the position where the liquid ejecting head 27 is to be wiped by the wiper cassette 70. Then, the cassette holder 52 moves backward, returning to the initial position.

Attachment Section

Figure 11:
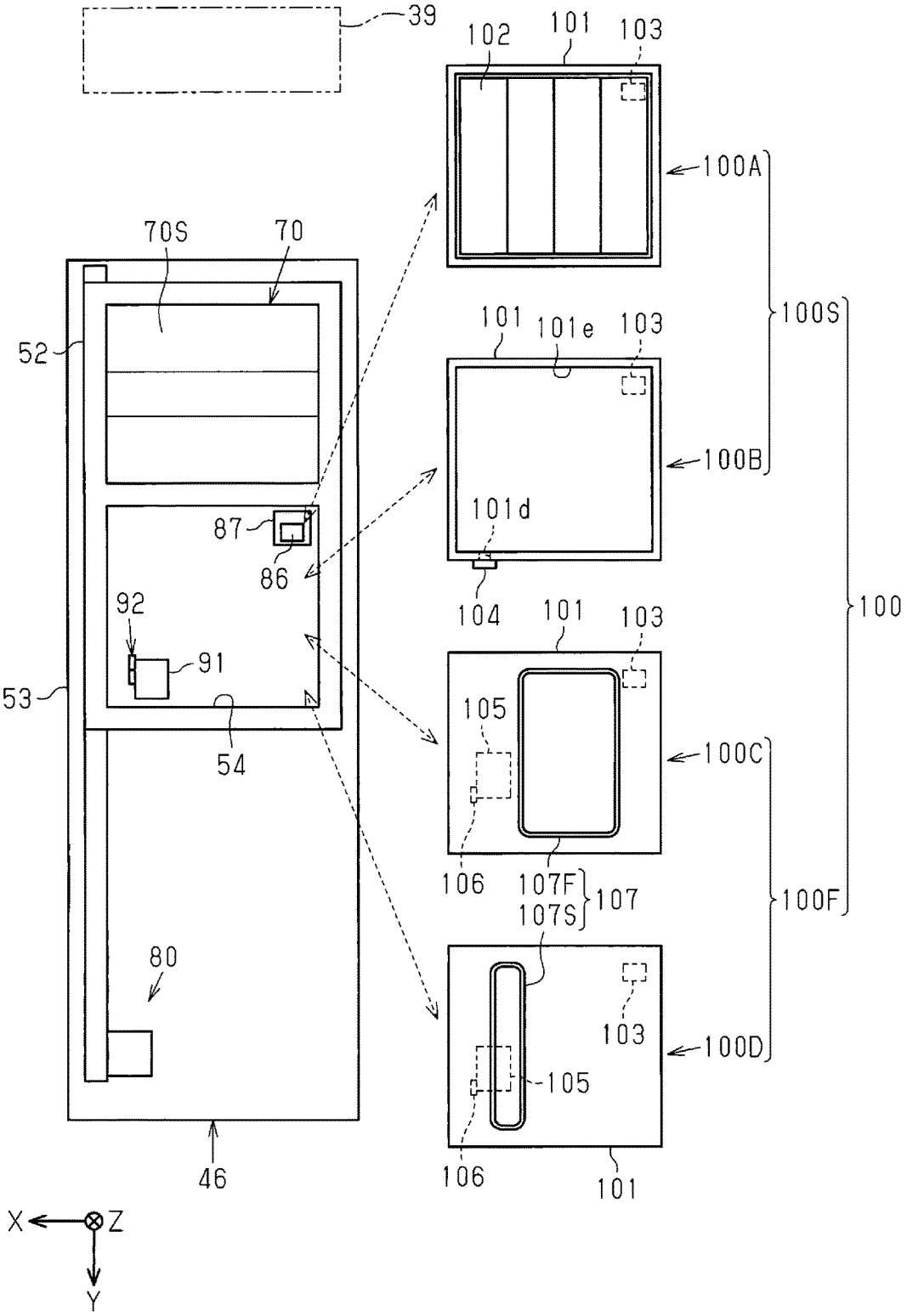
FIG. 11 is a plan view illustrating variations of the maintenance unit to be attached to an attachment section in the movable unit in FIG. 6.

As illustrated in FIG. 11, to the attachment section 54 in the movable unit 46, a maintenance unit 100, which includes the liquid receiving unit 100A and is used for the maintenance of the liquid ejecting head 27, is detachably attached. The attachment section 54 includes a drive source 91 and a driving-force transmission section 92 that transmits the driving force of the drive source 91. The drive source 91 is, for example, a motor. The driving-force transmission section 92 includes, for example, a gear train having a plurality of spur gears.

To the attachment section 54, the maintenance unit 100, which is a first unit 100F or a second unit 100S that have different structures, is detachably attached. The first unit 100F, which serves as the maintenance unit 100, includes a maintenance mechanism 105 that performs maintenance with the driving force transmitted from the attachment section 54. The second unit 100S, which serves as the maintenance unit 100, includes no maintenance mechanism 105. In other words, the second unit 100S is the maintenance unit 100 that requires no driving force.

Each of the maintenance units 100 includes the memory 103 that stores information concerning the structure of the corresponding maintenance unit 100. For example, the first unit 100F includes the memory 103 that has stored the information indicating that the first unit 100F is the "first unit 100F", and the second unit 100S includes the memory 103 that has stored the information indicating that the second unit 100S is the "second unit 100S".

The controller 39 reads the information from the memory 103 in the maintenance unit 100 attached to the attachment section 54 and identifies the structure of the attached maintenance unit 100. In this way, the connection terminal 86 and the controller 39 in the attachment section 54 function as an identification section that identifies the structure of the attached maintenance unit 100 based on the information concerning the structure stored in the memory 103.

An example of the second unit 100S is the liquid receiving unit 100A. Another example of the second unit 1005 is the liquid receiving unit 100B, which has no absorber 102. The liquid receiving unit 100B includes the container 101, which can store a liquid. The container 101 includes an opening 101*e* that can receive a liquid discharged from the nozzles 26, a discharge port 101*d* that discharges a stored liquid, and a cover 104 that opens or closes the discharge port 101*d*.

When a liquid has collected in the container 101 of the liquid receiving unit 100B, the user can detach the liquid receiving unit 100B from the attachment section 54, remove the cover 104, and discard the collected liquid from the discharge port 101*d*.

The maintenance mechanism 105 includes a passive section 106 that receives the driving force from the driving-force transmission section 92. The maintenance mechanism 105 is, for example, a pump for performing suction cleaning. In this case, the first unit 100F is a cap unit that includes the maintenance mechanism 105, which is a pump, a cap 107 that can provide a space for the nozzles 26 to open, a tube 108 (see FIG. 12) that connects the cap 107 and the pump, and an elevating mechanism 109 (see FIG. 12) for the cap 107 (see FIG. 12). The maintenance mechanism 105, the cap 107, the tube 108, and the elevating mechanism 109 are accommodated in the container 101 of the first unit 100F.

The first unit 100F includes, as cap units that have different structures, a first cap unit 100C that includes a first cap 107F, and a second cap unit 100D that includes a second cap 107S.

Among the four nozzle groups in the liquid ejecting head 27 in FIG. 2, the three nozzle groups that eject ink are referred to as first nozzle groups, and the one nozzle group that ejects a treatment liquid is referred to as a second nozzle group. If an ink is a first liquid and a treatment liquid is a second liquid, the first nozzle group is a group of the nozzles 26 that eject the first liquid, the second liquid group is a group of the nozzles 26 that eject the second liquid. The first cap 107F is a cap 107 that corresponding to the first nozzle group, and the second cap 107S is a cap 107 that corresponding to the second nozzle group.

Figure 12:
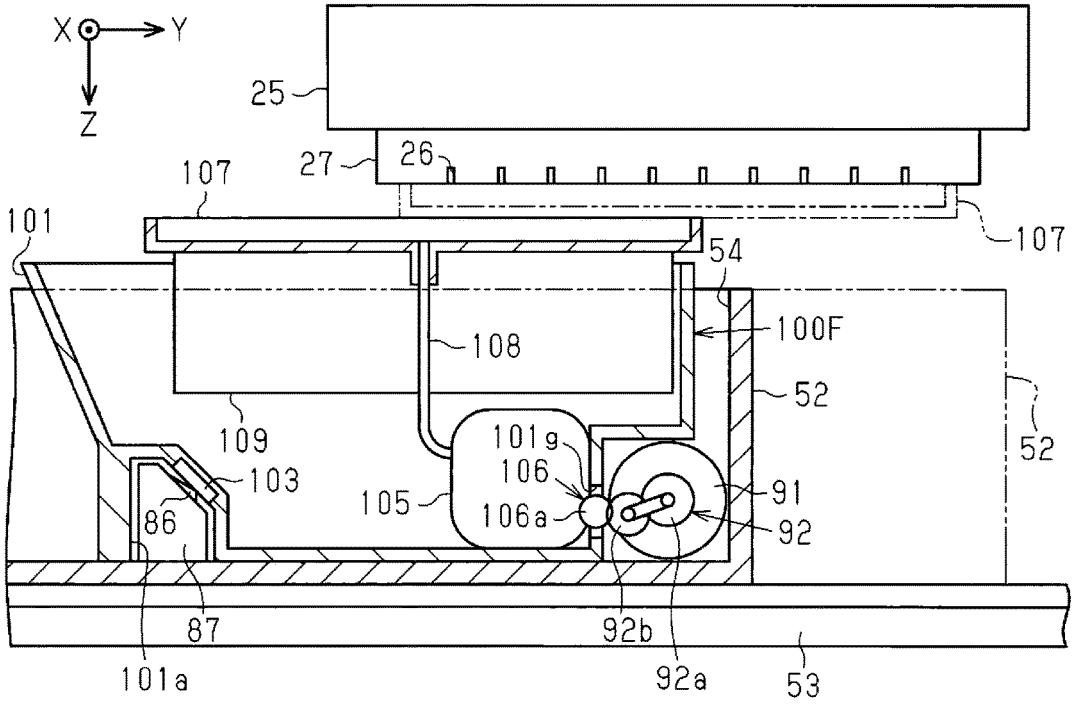
FIG. 12 is a cross-sectional view illustrating a first unit attached to an attachment section in FIG. 12.

As illustrated in FIG. 12, in response to the attachment of the first unit 100F to the attachment section 54, the driving-force transmission section 92 is connected to the passive section 106 of the attached first unit 100F. The connection enables the drive source 91 in the attachment section 54 to transmit the driving force to the first unit 100F via the driving-force transmission section 92 and the passive section 106. The container 101 of the first unit 100F may include an opening 101*g* for the passive section 106 to be exposed.

The driving-force transmission section 92 may be switched between a connection position (the position illustrated in FIG. 12) where the driving-force transmission section 92 is connected to the passive section 106 of the first unit 100F that has been attached to the attachment section 54, and a release position (the position illustrated in FIG. 13) where the driving-force transmission section 92 is separated from the passive section 106. This structure enables the driving-force transmission section 92 to be moved to the release position so as not to come into contact with the second unit 100S.

In this case, the driving-force transmission section 92 may be moved from the release position to the connection position if the controller 39 (see FIG. 11) has identified the first unit 100F that has been attached to the attachment section 54. This structure enables the driving-force transmission section 92 to be placed at the release position so as not to come into contact with the second unit 100S when the second unit 100S is attached. Furthermore, this structure enables the driving-force transmission section 92 to be placed at the connection position so as to be able to transmit the driving force when the first unit 100F is attached.

The driving-force transmission section 92 may be moved by the driving force of the drive source 91 from the release position to the connection position. For example, the driving-force transmission section 92 may include a sun gear 92*a* and a planet gear 92*b* such that in response to the rotation of the sun gear 92*a* by driving the drive source 91, the planet gear 92*b* is moved from the release position to the connection position to engage with the gear 106*a* in the passive section 106. The structure in which the driving force of the drive source 91 moves the driving-force transmission section 92 from the release position to the connection position eliminates a dedicated driving source for moving the driving-force transmission section 92.

The elevating mechanism 109 moves up and down the cap 107 between a capping position (indicated by the chain double-dashed lines in FIG. 12) at which the cap 107 comes into contact with the liquid ejecting head 27 and a position (indicated by the solid lines in FIG. 12) at which the cap 107 is separated from the liquid ejecting head 27. The elevating mechanism 109 may move the cap 107 in conjunction with the forward movement of the cassette holder 52, for example.

Figure 13:
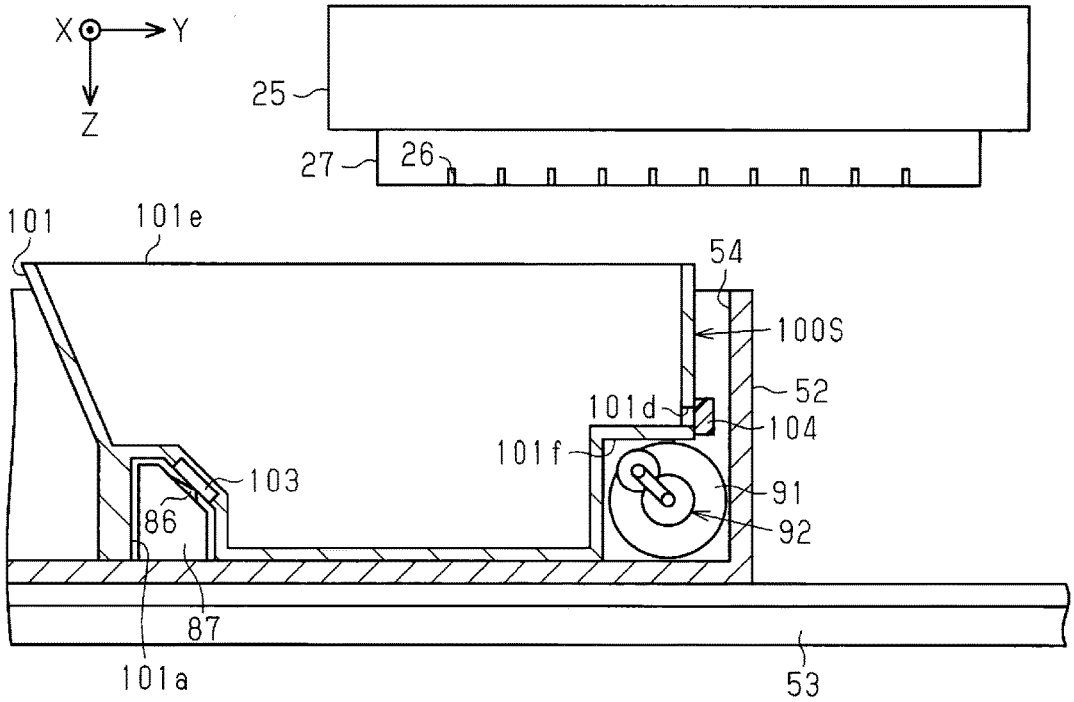
FIG. 13 is a cross-sectional view illustrating a second unit attached to the attachment section in FIG. 12.

As illustrated in FIG. 13, it is preferable that the driving-force transmission section 92 be positioned so as not to come into contact with the second unit 100S attached to the attachment section 54. For example, a notch 101*f* for preventing the connection between the drive source 91 and the driving-force transmission section 92 may be provided on a bottom section of the container 101 of the second unit 100S. Alternatively, a concave portion may be provided on an inside bottom section of the attachment section 54 to accommodate the drive source 91 and the driving-force transmission section 92 within the concave portion so as to prevent the driving-force transmission section 92 from coming into contact with the second unit 100S.

Next, an operation of the liquid ejecting apparatus 11 that has the above-described structure will be described. In response to the attachment of the maintenance unit 100 to the attachment section 54, the connection terminal 86 is connected to the memory 103 in the attached maintenance unit 100 and the controller 39 reads the information stored in the memory 103. Based on the read information, the controller 39 identifies the structure of the attached maintenance unit 100. Depending on the identified structure of the maintenance unit 100, the controller 39 performs the corresponding maintenance.

As illustrated in FIG. 12, when the cap unit, which is the first unit 100F, is attached to the attachment section 54, the driving-force transmission section 92 is connected to the passive section 106 of the first unit 100F. This connection enables the pump, which is the maintenance mechanism 105 in the first unit 100F, to be driven by the driving force of the drive source 91.

When the first cap unit 100C is attached to the attachment section 54, the first cap 107F can selectively perform capping to the first nozzle group. When the drive source 91 is driven while the capping is being performed, the ink, which is the first liquid, is sucked from the inside of the liquid ejecting head 27 through the nozzles 26 constituting the first nozzle group. This sucking operation discharges foreign matter such as bubbles as well as the ink. In this way, with the first cap unit 100C attached to the attachment section 54, the suction cleaning (selective cleaning) can be performed to the first nozzle group.

With the second cap unit 100D attached to the attachment section 54, the capping can be selectively performed to the second nozzle group with the second cap 107S. When the drive source 91 is driven while the capping is being performed, the treatment liquid, which is the second liquid, is sucked from the inside of the liquid ejecting head 27 through the nozzles 26 constituting the first nozzle group. This sucking operation discharges foreign matter such as bubbles as well as the treatment liquid. In this way, with the second cap unit 100D attached to the attachment section 54, the suction cleaning (selective cleaning) can be performed to the second nozzle group.

With the cap unit 48, the suction cleaning for simultaneously discharging the ink and the treatment liquid can be performed. The simultaneous suction of the ink and the treatment liquid, however, may cause the ink to harden in the cap 47 and the suction tube 51 due to the action of the treatment liquid, and the suction tube 51 may be clogged. Consequently, it is preferable that the first cap unit 100C and the second cap unit 100D be used to perform selective cleaning, in particular, when a plurality of liquids having different properties are to be ejected by the liquid ejecting head 27. Furthermore, when a liquid that tends to cause clogging such as an ink containing a pigment that tends to precipitate is to be ejected, the liquid may be selectively sucked and thereby the other liquids can be prevented from being unnecessarily consumed.

As illustrated in FIG. 13, when the liquid receiving unit 100B, which is the second unit 100S, is attached to the attachment section 54, flushing for discharging liquid from the liquid ejecting head 27 can be performed. In addition to the flushing, pressure cleaning for discharging pressurized liquid through the nozzles 26 may be performed.

The amount of liquid discharged by the pressure cleaning may be greater than the amount of liquid discharged by the flushing. In such a case, it is preferable that the liquid receiving unit 100B be used to receive the large amount of discharged liquid. The collected liquid can be discarded from the discharge port 101*d* by detaching the liquid receiving unit 100B from the attachment section 54 after the use of the liquid receiving unit 100B, and thereby the liquid receiving unit 100B can be repeatedly used.

The controller 39 may calculate the amount of liquid discharged in the maintenance and may cause the memory 103 in the second unit 100S to store the calculated value. In such a case, the controller 39 can read the amount of liquid received by the second unit 100S from the memory 103. Consequently, when the capacity of the second unit 100S has become full, it is preferable that the controller 39 notify the user that the capacity of the second unit 100S has become full.

The memory 103 in the maintenance unit 100 may store the number of times of attachment to the attachment section 54. Furthermore, the memory 103 in the cap unit may store the number of times of driving the pump or the driving time. The controller 39 may determine the useful life of the maintenance unit 100 based on the information stored in the memory 103. In such a case, when the maintenance unit 100 exceeding its useful life is attached, the controller 39 may prohibit the subsequent maintenance.

The liquid ejecting apparatus 11 according to the embodiment can achieve the following advantages.

1. When the liquid ejecting apparatus 11 has identified that the maintenance unit 100 attached to the attachment section 54 is the first unit 100F, the driving-force transmission section 92 transmits the driving force to the first unit 100F and the maintenance mechanism 105 performs maintenance to the liquid ejecting head 27. With this configuration, when the maintenance unit 100 having a certain structure is attached, maintenance operation corresponding to the structure can be readily performed.

2. The driving-force transmission section 92 is placed so as not to come into contact with the second unit 100S attached to the attachment section 54, and thus the second unit 100S can be appropriately attached to the attachment section 54 without coming into contact with the driving-force transmission section 92.

3. Based on the information stored in the memory 103, the structure of the attached maintenance unit 100 can be appropriately identified.

4. When the second unit 100S is attached to the attachment section 54, the liquid discharged from the nozzles 26 can be stored in the container 101 in the second unit 100S, and accordingly the liquid ejecting apparatus 11 can cope with the maintenance for discharging the liquid from the nozzles 26.

5. When the second unit 100S is attached to the attachment section 54, the suction cleaning can be performed as the maintenance for sucking the liquid inside the liquid ejecting head 27 through the nozzles 26.

6. When the first cap unit 100C is attached to the attachment section 54, the first liquid can be sucked through the first nozzle group. When the second cap unit 100D is attached to the attachment section 54, the second liquid can be sucked through the second nozzle group.

The above-described embodiment may be modified as in the following modifications. Any combination of the structures included in the above embodiment and structures included in the following modifications may be provided. Any combination of the structures included in the following modifications may be provided.

When the controller 39 identifies the first unit 100F attached to the attachment section 54, during the attachment, the driving-force transmission section 92 is not moved from the release position to the connection position, and when the maintenance operation is performed, the driving-force transmission section 92 may be moved from the release position to the connection position.

The maintenance mechanism 105 may be driven by the driving force of the electric motor 81 or the electric motor 88 without providing the drive source 91 in the attachment section 54.

If the lever 85 that is turned downward by the attachment of the maintenance unit 100 is provided, after the maintenance unit 100 has been identified as the first unit 100F, the driving-force transmission section 92 may be moved from the release position to the connection position in conjunction with the downward rotation of the lever 85.

A pressing section may be provided on an outer surface of the container 101, and a guide for guiding the movement of the driving-force transmission section 92 may be provided in the attachment section 54. When the pressing section of the maintenance unit 100 that moves toward the attachment section 54 presses the guide of the attachment section 54, the driving-force transmission section 92 may be moved. In this case, the pressing section of the first unit 100F may press the guide to move the driving-force transmission section 92 from the release position to the connection position, or the pressing section of the second unit 100S may press the guide to move the driving-force transmission section 92 from the connection position to the release position.

On the outer surfaces of the different containers 101 for the maintenance unit 100, portions having different shapes may be provided respectively. The identification section may identify the shape of the portion to identify the structure of the maintenance unit 100. In this case, the identification section may be a sensor for detecting a shape, or the identification section may be a concave-convex portion that engages with the shape of the container 101 to prevent the insertion of the maintenance unit 100 having a shape that fails to engage with the identification section.

The first unit 100F, which is the cap unit, may include a waste liquid storage section that can store a liquid discharged by suction.

The first unit 100F, which is the cap unit, may include a discharge tube for discharging a liquid sucked by a pump. When the cap unit is attached to the attachment section 54, the discharge tube may be connected to the waste liquid tank 79. In this case, the liquid discharged by the suction cleaning by using the cap unit may be stored in the waste liquid tank 79.

When the first unit 100F, which is the cap unit, is used for the suction cleaning, the liquid discharged by the suction may be discharged into a container other than the waste liquid tank 79. For example, a downstream end of the discharge tube of the first unit 100F may be extended to the outside of the liquid ejecting apparatus 11 and the liquid may be discharged into a container, or the like provided outside the liquid ejecting apparatus 11.

A discharge hole may be provided in a bottom section of the container 101 in the second unit 100S. A received liquid may be discharged through the discharge hole. In this case, a liquid absorber for collecting the liquid or a waste liquid flow path may be provided at a position in the attachment section 54 below the discharge port.

The liquid receiving unit 100B or the attachment section 54 may include a sensor capable of detecting a liquid stored in the liquid receiving unit 100B. In this case when the sensor detects that the amount of the liquid stored in the liquid receiving unit 100B has become a value corresponding to the capacity, the controller 39 may warn the user to detach the liquid receiving unit 100B.

The liquid receiving units 100A and 100B, which are the second units 100S, may receive a cleaning liquid used to clean the liquid ejecting head 27 as well as a liquid discharged by the liquid ejecting head 27.

A third unit may be attached as the maintenance unit 100 to the attachment section 54. The third unit is a maintenance unit 100 that includes a drive source and a maintenance mechanism that is driven by the driving force of the drive source.

An example first unit 100F or an example third unit may include a cleaning liquid ejecting unit that includes a cleaning liquid ejecting mechanism as the maintenance mechanism. The cleaning liquid ejecting unit drives a pump with the driving force of the drive source to eject the cleaning liquid to clean the liquid ejecting head 27.

An example first unit 100F or an example third unit may include a cleaning liquid supply unit that includes a cleaning liquid supply mechanism as the maintenance mechanism. The cleaning liquid supply unit drives a pump with the driving force of the drive source to supply the cleaning liquid to the fabric sheet 70S in the wiper cassette 70. With the cleaning liquid supply unit, the fabric sheet 70S can be moistened with the cleaning liquid and wiping can be performed with the moistened fabric sheet 70S.

The positions of the liquid receiving unit 100A and the wiper cassette 70 in the movable unit 46 in the Y-axis direction may be switched. In this case, when the liquid receiving unit 100A is disposed below (scanning region) the liquid ejecting head 27, the wiper cassette 70 is disposed at an initial position that is set at a position closer to the downstream side in the transport direction than the scanning region. With this arrangement, when the cassette holder 52 moves forward from the initial position toward the upstream side in the transport direction, the fabric sheet 70S wipes the liquid ejecting head 27, and after the wiping, the cassette holder 52 moves backward toward the downstream side in the transport direction and returns to the initial position.

The flushing unit 45 may include a plurality of liquid receiving sections 44 that correspond to a plurality of liquid ejecting heads 27 respectively. For example, two liquid receiving sections 44 may be arranged such that when a first liquid receiving section 44 is positioned below the liquid ejecting head 27 closer to the home position HP in FIG. 2, a second liquid receiving section 44 may be positioned below the other liquid ejecting head 27.

The liquid that is discharged by the liquid ejecting head 27 is not limited to the ink, and alternatively, the liquid may be, for example, a liquid material that contains particles of a functional material dispersed or mixed in a liquid. For example, the liquid ejecting head 27 may discharge a liquid material containing a dispersed or dissolved material such as an electrode material or a color material (pixel material) used for manufacturing liquid crystal displays, electroluminescence (EL) displays, or field emission displays (FEDs).

The medium 13 is not limited to paper, and alternatively, for example, plastic films, or thin plate materials, or cloths used in printing apparatuses may be used. The medium 13 may be clothes of any shape such as a T-shirt, or a three-dimensional object of any shape such as a dish or stationery.

The entire disclosure of Japanese Patent Application No. 2017-140765, filed Jul. 20, 2017, is expressly incorporated by reference herein.

What is claimed is:

1. A liquid ejecting apparatus comprising:

a liquid ejecting head having nozzles for ejecting a liquid; and an attachment section to which a maintenance unit to be used for maintenance of the liquid ejecting head is to be detachably attached, wherein the maintenance unit having a maintenance mechanism for performing the maintenance by driving force transmitted from the attachment section is a first unit and the maintenance unit having no maintenance mechanism is a second unit, one of a plurality of the maintenance units including the first unit and the second unit and having different structure is interchangeably attached to the attachment section, and the attachment section includes an identification section configured to identify the structure of the attached maintenance unit and a driving-force transmission section configured to transmit the driving force to the attached first unit.

2. The liquid ejecting apparatus according to claim 1, wherein the driving-force transmission section is arranged so as not to come into contact with the second unit that has been attached to the attachment section.

3. The liquid ejecting apparatus according to claim 1, wherein the maintenance mechanism includes a passive section configured to receive driving force from the driving-force transmission section, and the driving-force transmission section is configured to be moved between a connection section at which the driving-force transmission section is connected to the passive section of the first unit that has been attached to the attachment section, and a release position at which the driving-force transmission section is separated from the passive section.

4. The liquid ejecting apparatus according to claim 3, wherein when the identification section identifies the first unit that has been attached to the attachment section, the driving-force transmission section is moved from the release position to the connection position.

5. The liquid ejecting apparatus according to claim 4, wherein the driving-force transmission section is configured to be moved from the release position to the connection position by the driving force.

6. The liquid ejecting apparatus according to claim 1, wherein the maintenance unit includes a memory that stores information concerning the structure of the maintenance unit, and the identification section identifies the structure based on the information stored in the memory.

7. The liquid ejecting apparatus according to claim 1, wherein the second unit includes a container having an opening capable of receiving the liquid discharged from the nozzles.

8. The liquid ejecting apparatus according to claim 1, wherein the first unit is a cap unit including a cap capable of forming a space where the nozzles open and a pump that serves as the maintenance mechanism capable of sucking inside the space.

9. The liquid ejecting apparatus according to claim 8, wherein if the liquid includes a first liquid and a second liquid of different types, a group of the nozzles for ejecting the first liquid is a first group and a group of the nozzles for ejecting the second liquid is a second group, the cap corresponding to the first nozzle group is a first cap and the cap corresponding to the second nozzle group is a second cap, the liquid ejecting head includes the first nozzle group and the second nozzle group, and the first unit includes a first cap unit that includes the first cap and a second cap unit that includes the second cap as the cap units that have different structures.

* * * * *